US005443417A

United States Patent [19]

Schimweg

[11] Patent Number: 5,443,417

[45] Date of Patent: Aug. 22, 1995

[54] ON EDGE HONING DEVICES

[75] Inventor: John J. Schimweg, St. Charles, Mo.

[73] Assignee: Sunnen Products Company, St. Louis, Mo.

[21] Appl. No.: 977,917

[22] Filed: Nov. 18, 1992

[51] Int. Cl.[6] ..... B24D 3/00

[52] U.S. Cl. ..... 451/540; 451/463; 451/464; 451/470; 451/477

[58] Field of Search ..... 51/293, 297, 295, 308, 51/309, 330, 331, 336, 337, 338, 339, 347, 204, 205 WG

[56] References Cited

U.S. PATENT DOCUMENTS

| | | | |
|---|---|---|---|
| 2,799,127 | 7/1957 | Sunnen | 51/184.3 |
| 3,216,155 | 11/1965 | Sunnen | 51/347 |
| 3,225,496 | 12/1965 | Sunnen | 51/355 |
| 4,462,189 | 7/1984 | Puybaraud | 51/338 |
| 4,471,576 | 9/1984 | Corley | 51/338 |
| 4,505,076 | 3/1985 | Sunnen | 51/331 |
| 4,651,475 | 3/1987 | Appleby et al. | 51/338 |
| 4,974,373 | 12/1990 | Kawashima | 51/298 |
| 5,011,514 | 4/1991 | Cho et al. | 51/309 |
| 5,151,107 | 9/1992 | Cho et al. | 51/309 |
| 5,178,643 | 1/1993 | Schimweg | 51/309 |

*Primary Examiner*—Maurina T. Rachuba

*Attorney, Agent, or Firm*—Haverstock, Garrett & Roberts

[57] ABSTRACT

A honing device for mounting on a honing tool for rotation therewith including a backing material having opposite end surfaces, opposite side surfaces, and an edge surface extending between the opposed end and side surfaces, and a layer of an abrasive such as a superabrasive material and a binder attached onto one of the side faces and extending therealong to the edge surface whereby an edge of the abrasive layer and the adjacent edge surface engage the workpiece surface to be honed.

23 Claims, 4 Drawing Sheets

ON EDGE HONING DEVICES

BACKGROUND OF THE INVENTION

Honing devices with many types of honing mandrels, assemblies and abrasive members have been developed and used for a wide range of applications. Typical of the known honing devices are those disclosed in U.S. Pat. Nos. 2,799,127, 3,216,155, 3,225,496 and 4,651,475. Such honing devices provide for the rotation of abrasive members, where the abrasive surface of the member faces and is in direct surface-to-surface contact with the surface of the worked material. During rotation of the abrasive member in the bore of the worked material, the face of the abrasive element contacts and abrades the surface of the worked material and removes material as it rotates and is pressed thereagainst.

Disadvantages of the known honing devices result from the relatively large surface of the abrasive element in substantial contact with the surface of the bore being honed and the limited pressures that can be applied per unit area. Also, friction-related heat is produced when the abrasive surfaces are rotated during the honing process and increases substantially as the honing pressure and/or speed of rotation increases. Furthermore, when conventionally bonded abrasives are used, the abrasive surface does not always wear evenly and it is often difficult and time consuming to accurately true in or dress to preserve the honing accuracy. In addition, the waste materials formed through the abrading process build up on the abrasive surface and reduce the efficiency of the honing element. Not only are the more conventional abrasive members thicker, requiring more abrasive, but the resulting heat and friction often lead to fouling of the work surface and further reduce the efficiency.

One of the more pertinent prior art devices to the present invention is disclosed in Appelby et al U.S. Pat. No. 4,651,475 which discloses a honing tool with a relatively thick (0.125") abrasive strip attached to a wooden backing member of even greater thickness. The abrasive strip is situated so that a relatively narrow edge surface of the strip or strips is in contact with the material being worked. The honing tool still produces significant friction and heat, especially if relatively high honing pressures and speeds are used.

The present invention is directed to a honing device and specifically to an abrasive element having opposite side and end surfaces and an outermost edge surface extending to adjacent to the side and end surfaces, said element having a layer of a hard material such as a superabrasive material and a binder attached on and extending the length of one of the side surfaces and to and along one of the edge surfaces. Importantly, unlike the known honing art, the abrasive element of the present construction is formed of a backing member with a thin coating of superabrasive material and binder, attached on one, and in some cases more than one, of the side surfaces. When used, the subject honing element is mounted on a honing assembly such that only an edge, not a face, of the superabrasive layer or layers along one side of the edge surface engages the work surface to be honed. This enables a user of the present honing device to achieve improved economics of honing through improved abrasive wear rates, while enabling use of higher honing pressures and speeds, and producing less waste and less fouling due to waste build up on the abrasive surface and on the workpiece. Furthermore, because only an edge of the abrasive layer engages the work, it is relatively easy to redress the honing element when need be. These features in a honing tool represent important improvements in the honing art.

SUMMARY OF THE INVENTION

The present invention relates to the construction and operation of on edge honing devices having backing portions with one or more layers of superabrasive material arranged on the backing member in a manner so as to present an edge or edges, as distinguished from the entire face or faces of the abrasive layer or layers, to engage the surface to be honed. The layer of superabrasive material and binder are attached onto the backing material, or on layers previously attached thereto in the case of multi-layer constructions to increase the thickness of the honing edge engaged with the surface to be honed. Unlike known honing devices, the honing devices described herein enable a user to achieve improved honing characteristics and good honing tool life while at the same time providing good wear characteristics and in a construction that can be relatively easily dressed to restore its honing accuracy. Importantly, the invention contemplates mounting the honing device so that only an edge or edges of the superabrasive material attached on one or more of the side surfaces of the device engages the surface of the workpiece to be honed. This invention is important to the honing industry because it teaches an entirely different and more accurate and efficient approach to honing.

The present honing device is also beneficial because of the minimal surface contact between the abrasive portion of the honing element and the surface of the material to be worked, it enables higher honing pressure to be used thereby increasing the honing rate and honing efficiency, and it reduces the build up of waste material on the abrasive surface and on the workpiece. The narrow surface contact of the abrasive layer edge also reduces the time involved in set up and truing in or dressing of the elements.

OBJECTS OF THE INVENTION

It is therefore a principal object of the present invention to teach the construction and operation of a honing device having one or more side surfaces of a work engaging honing element formed by attaching thereon a layer of an abrasive such as a superabrasive material, said element being operated by presenting an edge of the abrasive layer or layers to the surface of a workpiece to be honed.

Another object is to teach the construction of a honing machine that includes a honing device that presents only an edge of one or more layers of a superabrasive material for contact with the surface being honed.

Another object is to make it relatively easy to accurately dress a honing device that uses a superabrasive honing material.

Another object is to provide a novel abrasive honing member that can be used on many existing honing machines without requiring substantial machine modification.

Another object is to enable existing honing machines to hone at higher honing pressures.

Another object is to provide an improved honing device which is relatively inexpensive to make and has a long usable life.

Another object is to increase the range of wear and adjustment of a honing member that employs a superabrasive.

These and other objects and advantages of the present invention will become apparent to those skilled in the art after considering the following detailed specification in conjunction with the accompanying drawings.

DETAILED DESCRIPTION OF THE PREFERRED EMBODIMENTS

Figure 1:
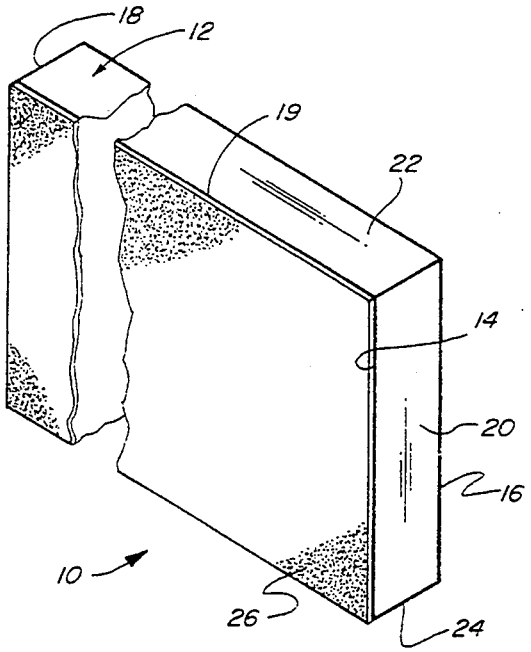
FIG. 1 is an enlarged perspective view of a honing member constructed according to the teachings of the present invention.

Referring to the drawings more particularly by reference numbers, number 10 in FIG. 1 refers to an on edge honing member constructed according to the present invention. The member 10 includes a metal or ceramic backing or support member 12 which has side faces 14 and 16, end faces 18 and 20 and edge faces 22 and 24. Attached to one of the side faces, such as the side face 14, is an abrasive layer 26 which includes particles of an abrasive material such as of a superabrasive material and a binder. The superabrasive material and the binder are attached onto the side face 14 of the backing member 12 and extend the length thereof and to the adjacent edge 19 of the edge face 22. Typical of the abrasives that can be attached onto a backing member in this manner are superabrasives formed by particles of materials such as diamond particles or particles of cubic boron nitride mixed with a binder. A plurality of layers of such superabrasive particles and binders can also be attached onto the metal or ceramic backing member. It is also possible to attach abrasives to both opposite surfaces 14 and 16 of the support member 12 as will be discussed although it is usually necessary and desired to attach abrasives to only one surface, usually the surface that faces in the direction of rotation of the honing member 10 when mounted on a honing mandrel or like device.

Figure 2:
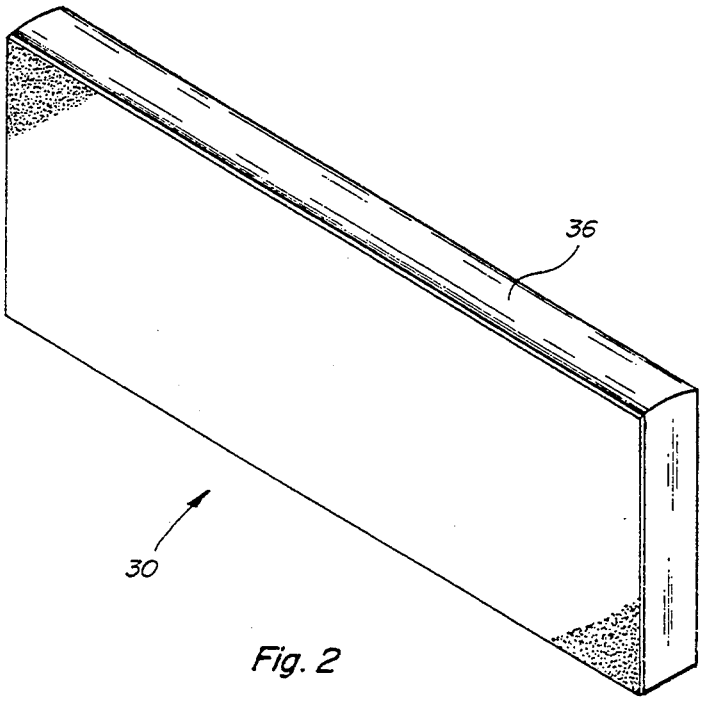
FIG. 2 is an enlarged perspective view showing another embodiment of the subject honing member.

As a step of manufacture or as a result of wear during honing, the surface of the honing member engaged with the workpiece surface being honed will be made to conform to the diameter of the workpiece surface. This means that the edge surface 36 (FIG. 2) of honing member 30 will be modified from that shown in FIG. 1 to a rounded condition. The material of the backing member 12 as shown in FIG. 1, will wear away relatively rapidly leaving the edge of the abrasive layer 26 in contact with the workpiece surface to do the honing. After a period of honing activity it may be necessary to dress the edge of the abrasive layer 26 to keep the abrasive edge true. Because of the thinness of the abrasive layer 26 and the fact that the backing material is relatively easily reshaped, dressing the edge is usually a relatively easy matter to perform.

Figure 3:
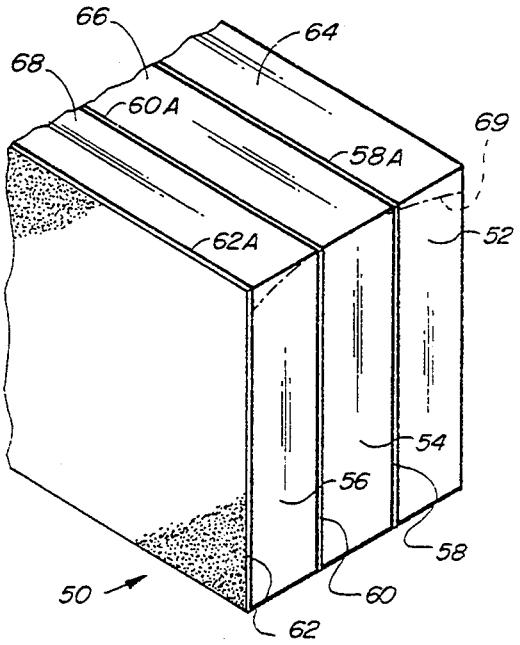
FIG. 3 is an enlarged perspective partial section view showing another embodiment of the subject honing member.

In FIG. 3 there is shown greatly enlarged a construction 50 formed by a plurality of adjacent backing members 52, 54 and 56 each of which has a layer 58, 60 and 62 of an abrasive attached onto one surface thereof. In this construction, as in FIG. 1, the layers 58, 60 and 62 extend to the edge faces 64, 66 and 68 of the respective backing members 52, 54 and 56. This is done so that when the construction 50 is mounted on a honing assembly for rotation therewith an edge 58A, 60A and 62A of each of the surfaces 58, 60 and 62 is able to engage a workpiece surface to be honed. In the construction 50, the surfaces 64, 66 and 68 will also be rounded to form surface 69 shown in dotted outline to conform to the contour of the surface being honed, and to enable the abrasive edges 58A, 60A and 62A to share in the honing. This, as in other embodiments of the present device, is to be contrasted with more conventional honing assemblies which are made of abrasive material such as a vitreous bonded abrasive grit that presents its whole face width to the surface being honed. Typically a vitrified abrasive member will be in the shape of a block which is attached to a metal backing member or the like, and the whole of one of the exposed surfaces of the block will engage the workpiece surface and perform the honing. There are also honing mandrels that have a layer of a superabrasive formed extending completely or substantially completely over the surface that engages the workpiece, such as the surfaces 22, 36, 64, 66 and 68 of the constructions shown in FIGS. 1, 2 and 3. With the present construction, the workpiece surfaces are engaged by the backing surfaces 22, 36, 64, 66 and 68 but the honing is done by an edge of one or more layers of superabrasive. This is an important difference between the present construction and the more conventional constructions and means that the present honing members which use superabrasives are nevertheless able to withstand relatively high honing pressures and therefore are able to hone at faster rates than when honing with thicker, more conventional bonded abrasive members. Also, and importantly, by having only a thin edge of the abrasive layer or layers engage the work surface, it is possible to relatively easily dress the present honing members to restore to them to a high degree of honing accuracy which is not possible with the more conventional honing members which have their entire surfaces, not just edges, that must be dressed. This is highly desirable especially in a construction that enables considerable radial dressing before a honing member needs to be discarded. In other words by attaching a relatively thin layer of abrasive grit to one or more side faces of the present honing members the honing members can continue to be used over a wide radial range to compensate for radial movement or adjustment.

Figure 4:
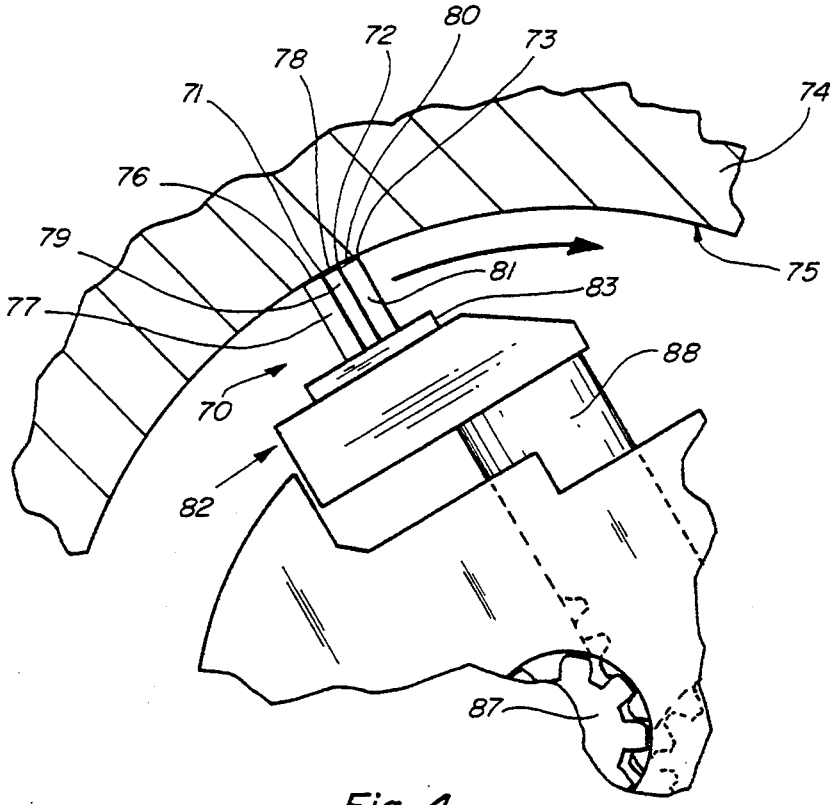
FIG. 4 is a fragmentary end view of a mandrel having a honing member of the subject construction positioned in a bore to be honed.

FIG. 4 shows another embodiment 70 of a honing device or mandrel embodying the use of work engaging honing assembly 82 that has the edges of abrasive layers 71, 72 and 73 of a honing member 83 that engage a work surface 75 on a workpiece 74 during honing thereof. In the construction shown in FIG. 4 a portion of the radially movable honing assembly 82 is shown, including rack gears 88 which engage and are moved by a pinion gear 87 located centrally on the axis of the body of the mandrel 70. Each honing assembly 82 has its work engaging member 83 formed by a plurality of adjacent backing members 77, 79 and 81, one surface of each backing member 77, 79 and 81 having one of the layers 71, 72 and 73 of superabrasive material attached thereon as shown. The construction of the work engaging portion of the honing assembly 82 may be similar to the honing member 50 shown in FIG. 3.

The outer face of the abrasive assembly 82 engages the work surface or bore 75 of a workpiece 74. The backing members 77, 79 and 81 have edge surfaces 76, 78 and 80 that engage the work surface 75 that are rounded either during manufacturing or during use to conform to the shape of the workpiece surface 75. In addition, the individual backing members 77, 79 and 81 may have dissimilar heights to form a staggered construction which orients the edge surfaces 76, 78 and 80 to conform to the contour of the workpiece surface. The manner in which the honing members are attached to the honing assemblies can be by conventional means for such devices, and it is usually desirable to have the abrasive layers 71, 72 and 73 in the assemblies on the forwardly facing surfaces of the backing members 77, 79 and 81 rather than the other way around.

Figure 5:
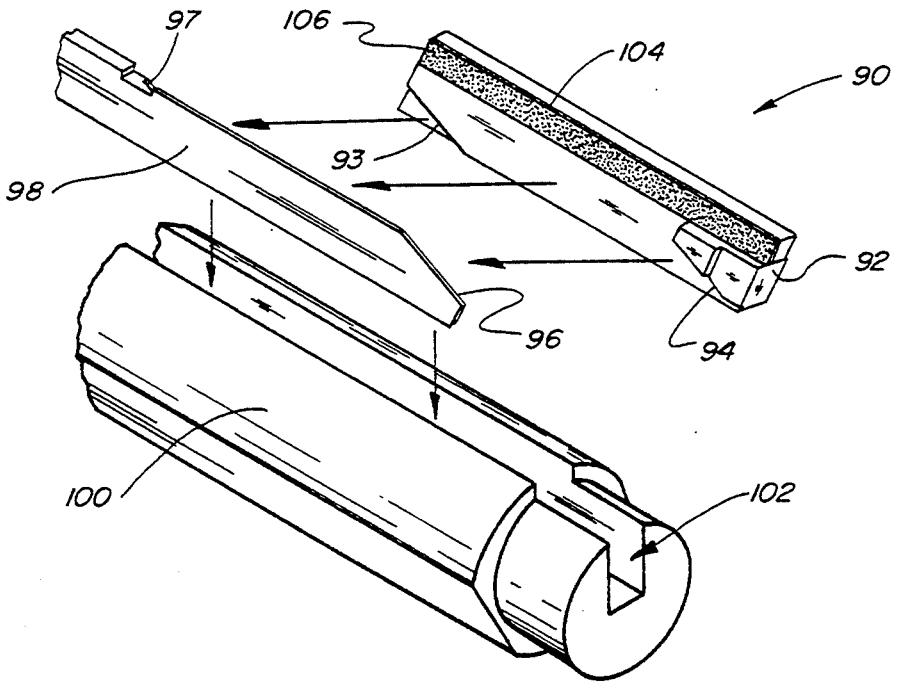
FIG. 5 is an exploded perspective view of a honing mandrel assembly having a honing member embodying the teachings of the present inventions.
Figure 6:
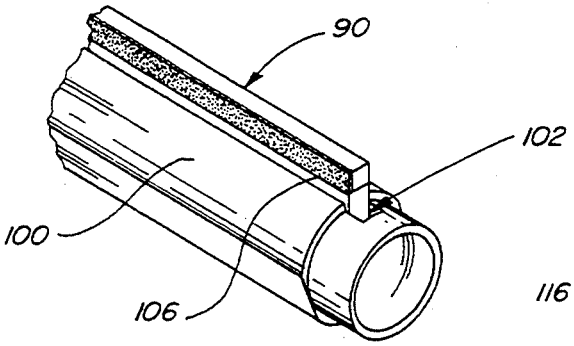
FIG. 6 is a fragmentary perspective view of the honing mandrel assembly of FIG. 5 with the parts assembled for operation.

FIGS. 5 and 6 show another form of honing assembly 90 incorporating the teachings of the present invention. The assembly 90 is of the type that can be installed and used in many well known mandrel constructions such as those shown in Sunnen's U.S. Pat. Nos. 2,799,127, 3,225,496 and 4,651,475. In this construction, the assembly 90 includes a backing portion 92 usually of metal having tapered surfaces 93 and 94 which are slideably engaged by corresponding tapered surfaces 96 and 97 on a wedge member 98. The stone assembly 90 and the wedge 98 are mounted in a groove 102 in one side of a mandrel body 100, and when the wedge member 98 is moved axially in one direction in the groove 102 it causes the stone assembly 90 to move radially outwardly into engagement, under pressure, with the workpiece surface being honed. In FIG. 5 the honing assembly 90 is shown having one of its side faces 104 coated with a layer 106 of a superabrasive material and a binder in a manner similar to the constructions described above and shown in FIG. 1. The honing assembly 90 is installed in the groove 102 in the honing mandrel 100 as shown in FIG. 6.

Figure 7:
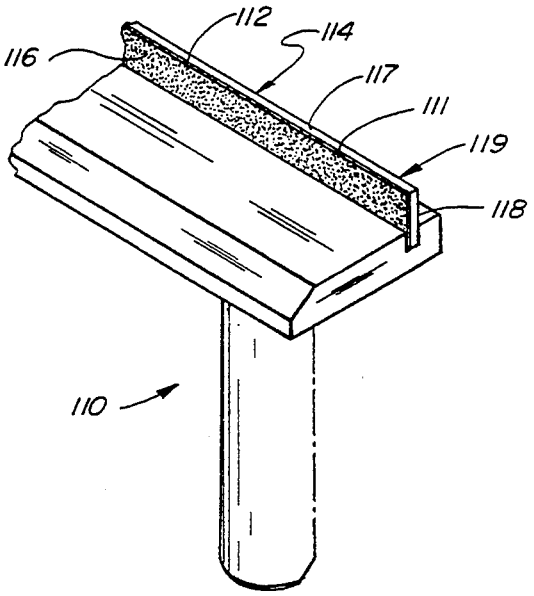
FIG. 7 is a perspective view of a portion of another embodiment of a honing assembly having a honing member constructed according to the present invention.
Figure 8:
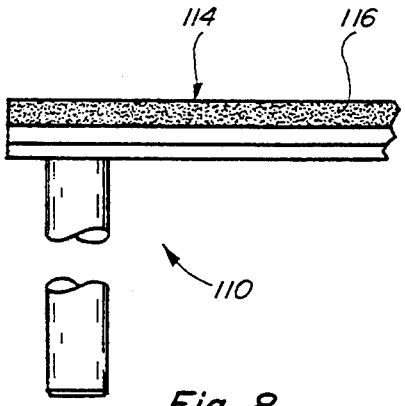
FIG. 8 is a side elevational view of another portion of the honing assembly embodiment shown in FIG. 7.

Another honing assembly construction 110 is shown in FIGS. 7 and 8 and such are for mounting on honing tools such as the tools shown in Sunnen U.S. Pat. No. 4,505,076. Importantly, the honing assembly 110 includes a honing member 114 having a thin superabrasive layer 116 attached to one or both opposite side surfaces 112 and 118 of the backing member 119. During normal rotation of the work engaging portions of the honing assembly 110, only an edge face 117 and the adjacent edge 111 of the abrasive layer 116 engage the work surface to be honed. The honing assembly 110 may incorporate a single honing element such as element 114 as shown in FIG. 7 or it can have a plurality of such single honing elements separately mounted on the honing assembly, each honing element having one or more abrasive elements as shown in FIGS. 1 and 3. Alternatively, the honing member can be mounted against a locating ridge on the honing assembly. In either case, the honing will take place by operation of the edge or edges of the abrasive layers, and the backing material that engages the work will wear to conform to the contour of the work surface.

Figure 9:
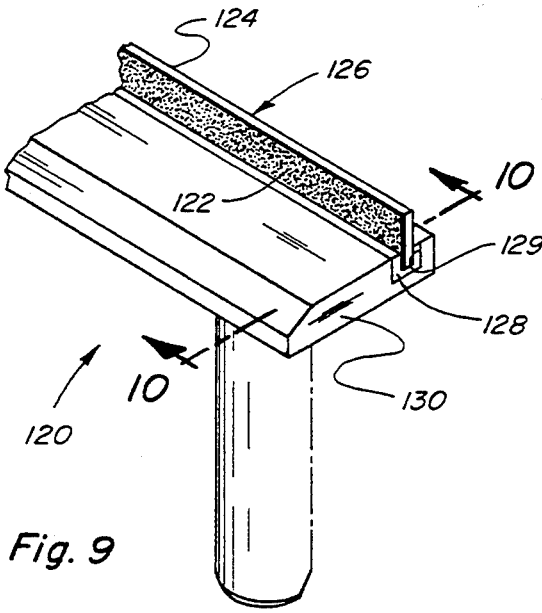
FIG. 9 is a fragmentary perspective view of another embodiment of the honing assembly shown in FIG. 7.
Figure 10:
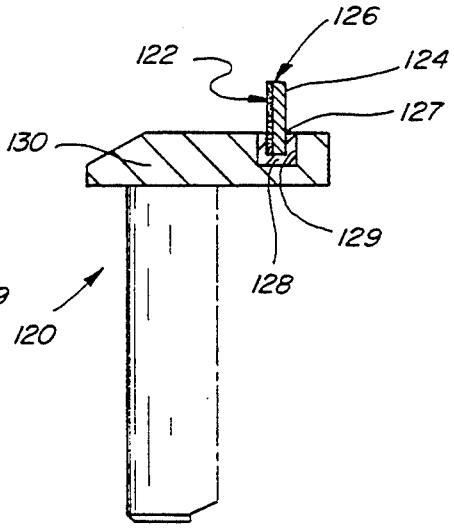
FIG. 10 is a cross-sectional view taking on line 10—10 of FIG. 9.

FIGS. 9 and 10 show another way of mounting a honing member such as member 126 on a honing assembly 120. To enable the use of thin, on edge honing members on such honing assemblies, the honing members 126 can initially be attached to a base plate or adapter 128 for subsequent mounting in a groove 129 formed in support member 130 of the assembly 120. The base adapter 128 is constructed from metal materials such as from steel, nickel phosphorous coated metals or zinc and is sized to fit into the groove 129, extending the length of the member 130. The attachment means for attaching the honing member to the base adapter of this construction may include solders with melting temperature ranges above about 300° F., and preferably between 450°–550° F., or it may be attached by adhesives such as by epoxies.

Figure 11:
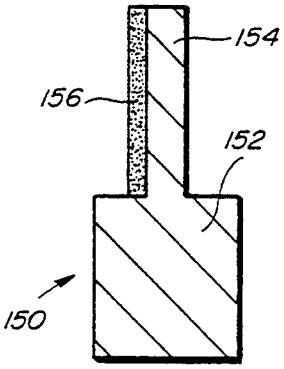
FIGS. 11–17 are cross-sectional views showing various other embodiments of the subject honing device.
Figure 12:
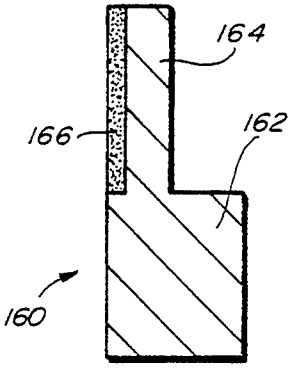

FIGS. 11–12 show two other embodiments 150 and 160 of the subject honing member also designed to be used on traditional honing assemblies wherein the abrasive and binder layers 156 and 166 are applied to backing members 154 and 164 which are integral respectively with base adapters 152 and 162. These embodiments are to be contrasted with the previous honing members such as that shown in FIG. 9, where the superabrasive layered backing member 126 was initially attached to the adapter base 128 for subsequent attachment to the honing assembly 120. In the embodiments 150 and 160, the edge, end and side faces of the backing members 152 and 162 are machined to form the resulting narrower portions 154 and 164 on which the abrasive is attached. The superabrasive and binder layers are then attached on the portions 154 and 164 as detailed below. The resulting one piece honing support members are relatively simple and inexpensive to make. In FIG. 11, the support portion 154 is at an intermediate location along one side of the length of the adapter base portion 152, whereas the superabrasive supporting member 164 in the FIG. 12 construction is located so that the superabrasive layer is flush or nearly flush with one side face of the adapter base portion 162.

Figure 13:
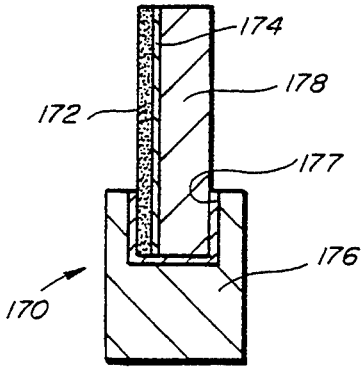

The embodiment 170 shown in FIG. 13 is a construction where the superabrasive component 172 is a thin sintered metal shim-like member 174 which is subsequently attached to a backing member 178 and then the assembled parts are mounted in a groove 177 in an adapter or base member 176 being attached therein by using an adhesive such as an epoxy or the like or by the use of solder. Alternatively the shim 174 could be attached to an integral support member as shown in FIGS. 11 or 12.

All of the abrasive layers or shims as shown are intended to be relatively thin, in the order of less than about 100 mils thick. When abrasive coated shim members or the like are used they can facilitate the mass production of the honing members by attaching lengths of standard coated shims to backing members of a desired size and shape.

Typical materials used for the backing members of the present invention can be, but are not limited to, the steels from iron alloyed with materials such as carbon, manganese, phosphorous, sulfur, silicon, chromium, nickel, molybdenum, copper, niobium, titanium, or tungsten. Cast iron and cast iron alloys, materials produced by powder metallurgy including tungsten and titanium carbide, elemental and alloys of non-ferrous materials such as aluminum, nickel, copper, tin, zinc, cobalt, silver, gold, titanium, platinum, and ceramic materials can also be used depending on the nature and hardness of the workpieces to be honed thereby. The cost, workability and hardness properties of these materials offer a wide range of flexibility in adapting the teachings of the invention to various honing applications. The abrading efficiency of conventionally bonded abrasive members is normally a function of the abrasive and bond that is used and the nature and hardness of the workpiece to be honed thereby. In the present invention, the hardness of the supporting or backing member, as well as the characterstics of the abrasive and binder materials to be used, are important factors that affect the honing characterstics and the range of wear of on edge oriented honing elements. The use of softer metals in the support structures will wear faster but may be better adapted to the honing of certain materials such as the softer workpieces, whereas harder metal backing materials may gouge such workpieces. The selected abrasive grit types and sizes are similarly important. Thus a wide range of applications can be satisfactorily provided for by balancing the properties of the abrasives and backing materials selected in the construction of the present on edge honing devices. Controlling the wear rate also allows for the modification of the grit efficiency, stock removal rate and honing member life.

Figure 14:
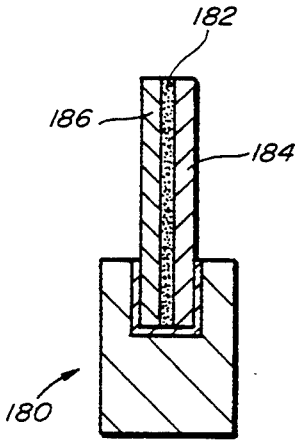

The embodiment 180 shown in FIG. 14 teaches the use of a superabrasive layer 182 sandwiched between two support portions or layers 184 and 186. The two support portions 184 and 186 may to a limited extent help to limit the wear rate of the superabrasive layer and may also provide some limited support for the superabrasive layer, thereby minimizing premature loss of abrasive through cracking or flaking off.

Figure 15:
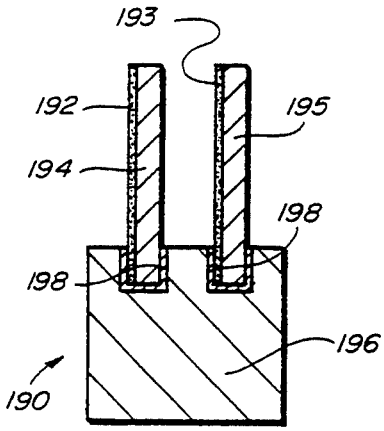
Figure 16:
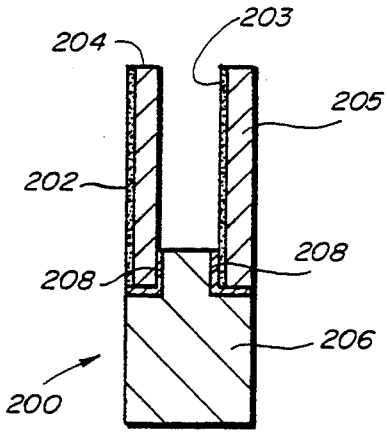

FIGS. 15 and 16 detail other embodiments 190 and 200 of the present invention wherein honing members or layers 192 and 193 and 202 and 203 are formed by superabrasive coatings applied to respective backing members 194, 195, 204 and 205, which members are attached to adapter bases 196 and 206 in one of the ways already described. The members can be installed in grooves 198 or against ledges 208 in the bases 196 and 206 as shown. The locations of the abrasive layers on the leading or trailing edges of the respective member, will depend on the use to be made of the member. All of the various embodiments allow efficient utilization of this novel technology and usually without requiring even minor modification of existing honing machines on which they will be used.

Figure 17:
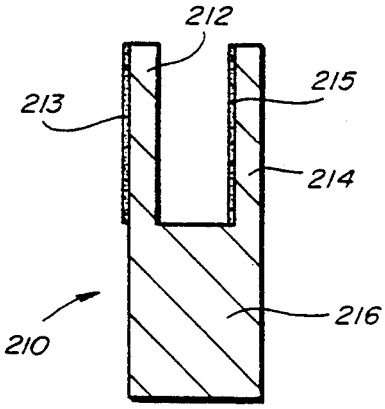

FIG. 17 shows yet another embodiment 210 wherein a plurality of backing portions 212 and 214 are formed integral with an adapter base 216, each having an abrasive layer 213 and 215 applied thereto.

On method of attaching abrasive grits to the backing member is by electrolytic or so called electroless plating. Soldering, brazing, and adhesives can also be used. The preferred process for plating an abrasive layer onto the backing member or shim is accomplished in three distinct phases or steps, including (1) a preplating step, (2) a tack on step and (3) a post plating step. Electrolytic plating can be used for some or all of the steps whereby electrons for metal reduction are supplied by a direct electrical current supply. Also electroless plating can be used where the electrons for metal reduction are supplied using a reducing chemical such as sodium hypophosphite, dimethylamine borane or formaldehyde.

Figure 18:
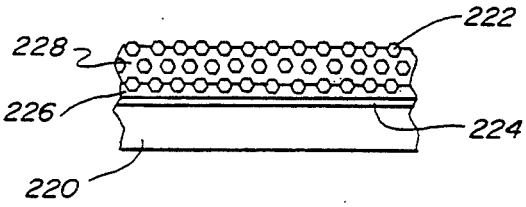
FIG. 18 a greatly enlarged fragmentary side elevational view showing a honing member having a plurality of layers of an abrasive material affixed on a surface thereof.

The preplate phase involves the plating of a thin layer of a metal binder 224 onto the backing member or substrate 220, as shown in FIG. 18. This step has been found to promote adhesion, to provide bearing surface for grit 222 and to alter the electrochemical characteristics of the substrate 220.

During the tack on phase, the particles of abrasive grit 222 are positioned against the surface to be plated as by employing an external restraint means, or by gravity or by electrophoresis. A thin layer of a suitable metal binder 226 is then deposited on the prepared substrate surface to entrap the abrasive particles next to the surface. A plating thickness of between about 0.01 micron to about 200 microns has been found in most applications to be sufficient to hold the particles in place on the substrate 220. Because the metal ions must migrate through layers of grit during this phase of the process, this plating step must be carried out relatively slowly to avoid concentration polarization. This step may be repeated to produce abrasive layers of the desired thickness or to include layers of different abrasives.

The post plating phase can be carried out at a faster rate after the excess grit particles have been washed away and external restraint means, if used, have been removed. Post plating proceeds with a binder 228 until the abrasive grit is engulfed to the extent required by the application. This phase can also be used to control the thickness of the abrasive layer that is applied.

Plated metal binders found useful for this application include nickel, chromium, cobalt, iron, tin, copper, and alloys such as nickel phosphorous, nickel boron, brass and bronze. Nickel has been found in most applications to have the most beneficial plating characteristics and strength.

The thin superabrasive layers as described and used have important advantages over the more conventional honing materials. The present invention contemplates the use of layers of abrasives between about 0.04 mil and about 60 mils thick, but preferrably between about 0.06 mil and about 20 mils thick, although other layer thickness can also be used. Depending on the composition of the backing member and the backing material's hardness properties, the total thickness of the honing member will typically vary from between about 1 mil and about 200 mils, but preferably is in the range between about 20 mils and about 120 mils thick for most applications. The narrow edges presented to the surface of the material being honed allow relatively long useful life and ease of dressability of the present honing devices as explained above.

Several embodiments of a novel on edge honing abrasive member have been shown and described, all of which fulfill all of the objects and advantages sought thereof. Changes, modifications, variations and other uses and applications of the present device will, however, become apparent to one skilled in the art after considering this specification and accompanying drawings. All such changes, modifications, variations and other uses and applications which do not depart from the spirit and scope of the invention are deemed to be covered by the invention which is limited only by the claims which follow.

What is claimed is:

1. A honing member for mounting on a honing assembly comprising an elongated metal body having opposite end surfaces, opposed side surfaces extending between the end surfaces and a work engaging surface extending between the end and side surfaces, a thin layer formed of particles of a superabrasive material and a binder attached to one of the side surfaces, the layer of superabrasive material being between about 0.04 mil to about 60 mils thick and extending between the end surfaces and adjacent to the work engaging surface forming a thin work engaging edge formed of superabrasive material therealong, and means for mounting the honing member on a honing assembly so that there is minimal edge to surface contact between the work engaging edge of the layer superabrasive material and the workpiece surface to be honed.

2. The honing member of claim 1 wherein the layer is formed of a superabrasive material that includes particles of diamond and the binder.

3. The honing member of claim 1 wherein the layer is formed of a superabrasive material that includes particles of cubic boron nitride and the binder.

4. The honing member of claim 1 wherein the elongated body is formed of steel.

5. The honing member of claim 1 wherein the elongated body is formed of cast iron.

6. The honing member of claim 1 wherein the elongated body is formed of alloyed products produced from a powdered metallurgical sustance.

7. The honing member in claim 1 wherein the layer of superabrasive material includes a single layer of superabrasive particles and a binder.

8. The honing member in claim 1 wherein the layer of superabrasive material is between about 0.06 mil and about 20 mils thick.

9. The honing member in claim 1 wherein the layer of superabrasive material and the binder includes a plurality of layers of superabrasive particles and a binder.

10. The honing member in claim 1 wherein the layer of superabrasive material and the binder form a sintered shim-like member, and the shim-like member is attached to a side surface of the elongated body.

11. The honing member in claim 1 wherein the layer of superabrasive material and the binder is applied to a strip of metal, and the strip of metal is attached to a side surface of the elongated body.

12. The honing member in claim 1 wherein the layer of superabrasive material and the binder is attached to the elongated body by a plating process.

13. The honing member of claim 1 wherein the binder is selected from the group consisting of nickel, chromium, cobalt, iron, tin, copper, nickel phosphorous, nickel boron, brass and boron.

14. An on edge honing device for installing on a mandrel for rotation therewith during honing of cylindrical workpiece surfaces, the mandrel having means thereon movable during honing to maintain the honing device engaged under load with the workpiece surface, the improvement residing in the construction of the honing device which comprises a plurality of metallic block shape members each having opposite end surfaces, opposite side surfaces extending between the end surfaces, and a work engaging surface extending between the end and side surfaces, each of said metallic block shaped members further including a layer formed of particles of a superabrasive material and a binder attached onto one of the opposite side surfaces and extending therealong to adjacent to said work engaging surface, and means for mounting the plurality of block shaped members on the mandrel in adjacent relationship such that the work engaging surface on each of said plurality of block shaped members and an edge of each layer formed of superabrasive material and a binder are engageable with a workpiece surface to be honed and so that there is minimal edge to surface contact between the edge of said layers and the workpiece surface during honing thereof.

15. The device of claim 14 wherein the mandrel includes means for mounting a plurality of similar on edge honing devices.

16. The device of claim 14 wherein the work engaging surface on each of the plurality of block shaped members conforms to the contour of the workpiece surface to be honed.

17. In an elongated honing mandrel rotatable about an axis of rotation including means for mounting at least one honing assembly thereon, the improvement residing in the construction of the honing assembly including a metallic elongated body portion adapted to be mounted on the honing mandrel for rotation therewith about the axis of rotation, the body having opposite end surfaces, opposite side surfaces extending between the end surfaces and a work engaging surface extending between the end and side surfaces and positioned on the mandrel to engage a surface to be honed, and a layer of a superabrasive material including a plurality of layers of superabrasive particles and a binder attached to one of the opposite side surfaces of the elongated body, the layer of superabrasive material being between about 0.04 mil to about 20 mils thick, an edge of said attached layer extending to said work engaging surface for making minimal edge to surface contact with a workpiece surface engaged thereby.

18. In the honing mandrel of claim 17 wherein the mandrel includes means for radially moving the honing assembly during operation.

19. In the honing mandrel of claim 18 wherein the honing mandrel has an elongated groove along one side and the honing assembly is mounted in the groove, at least one surface formed on the honing device at an acute angle relative to the axis of the mandrel and a wedge member positioned in the groove adjacent to the honing device, said wedge member having a surface thereon in surface-to-surface contact with the acutely angularly related surface on the honing device for moving the honing device radially relative to the mandrel when the wedge member is moved axially in one direction in the groove.

20. In the honing mandrel of claim 17 including a pinion gear mounted extending substantially along the axis of the honing mandrel, rack gears having teeth for engaging the pinion gear, honing means extending between pairs of aligned rack gears including a support member, and means on the support member for mounting the honing assembly.

21. In the honing mandrel of claim 17 including a strip of metal on which the layer of superabrasive material and a binder are attached, and means for attaching the strip of metal material to the elongated body with an edge of the layer of superabrasive material and a binder extending to adjacent said work engaging surface thereof.

22. A honing member for mounting on a honing assembly comprising a plurality of adjacent elongated metal bodies, each having opposite end surfaces, opposite side surfaces extending between the end surfaces and a work engaging surface extending between the end and side surfaces, a thin layer formed of particles of a superabrasive material and a binder attached to one of the side surfaces, the layer of superabrasive material extending between the end surfaces and adjacent to the work engaging surface forming a thin work engaging edge formed of superabrasive material therealong, said elongated metal bodies being mounted in side surface-to-side surface abutment on the honing member, and means for mounting the honing member on a honing assembly such that the work engaging edges of said layers of superabrasive material and the work engaging surfaces of the elongated bodies engage a workpiece surface to be honed thereby, there being only minimal edge to surface contact between the work engaging edges of superabrasive material and the workpiece surface to be honed.

23. A honing member for mounting on a honing assembly comprising first and second elongated metal bodies each having opposite end surfaces, opposed side surfaces extending between the end surfaces and a work engaging surface extending between the end and side surfaces, each elongated metal body further including a thin layer formed of particles of a superabrasive material and a binder attached to one of the side surfaces thereof, the layer of superabrasive material extending between the end surfaces and adjacent to the work engaging surface of the body forming a thin working engaging edge formed of superabrasive material therealong, said second elongated body attached to the layer of superabrasive material on the first elongated body such that the elongated bodies are in side surface-to-side surface abutment, and means for mounting the honing member on a honing assembly so that there is minimal edge to surface contact between the work engaging edges of the superabrasive material and the workpiece surface to be honed.

* * * * *